US008928492B2

(12) United States Patent
Boscacci

(10) Patent No.: US 8,928,492 B2
(45) Date of Patent: Jan. 6, 2015

(54) EMERGENCY SIGNAL INTERCEPTING UNIT

(76) Inventor: Anthony Joseph Boscacci, Aitkenvale (AU)

( * ) Notice: Subject to any disclaimer, the term of this patent is extended or adjusted under 35 U.S.C. 154(b) by 83 days.

(21) Appl. No.: 12/310,117

(22) PCT Filed: Aug. 7, 2007

(86) PCT No.: PCT/AU2007/001109

§ 371 (c)(1),
(2), (4) Date: Feb. 11, 2009

(87) PCT Pub. No.: WO2008/019424

PCT Pub. Date: Feb. 21, 2008

(65) Prior Publication Data

US 2010/0001879 A1 Jan. 7, 2010

(30) Foreign Application Priority Data

Aug. 18, 2006 (AU) ..... 2006203590

(51) Int. Cl.
*G08G 1/087* (2006.01)
*G08G 1/0965* (2006.01)
*G08B 25/00* (2006.01)

(52) U.S. Cl.
CPC ..... *G08G 1/0965* (2013.01); *G08B 25/001* (2013.01)
USPC ..... 340/902; 455/45; 455/228; 455/404.1; 455/521

(58) Field of Classification Search
CPC ..... G08G 1/087; G08G 1/0965
USPC ..... 455/45, 229, 228, 227, 404.1, 521; 340/902
See application file for complete search history.

(56) References Cited

U.S. PATENT DOCUMENTS

| | | | | | |
|---|---|---|---|---|---|
| 1,940,496 | A | * | 12/1933 | James | 363/33 |
| 3,784,970 | A | * | 1/1974 | Simpkin | 340/902 |
| 3,876,940 | A | * | 4/1975 | Wickord et al. | 455/341 |
| 3,921,074 | A | * | 11/1975 | Baird | 455/133 |
| 4,389,639 | A | * | 6/1983 | Torii et al. | 340/692 |
| 4,794,394 | A | | 12/1988 | Halstead | |
| 6,087,961 | A | * | 7/2000 | Markow | 340/902 |
| 6,630,891 | B1 | | 10/2003 | Dilling | 340/902 |

FOREIGN PATENT DOCUMENTS

GB 2343539 A 5/2000

* cited by examiner

*Primary Examiner* — Phung Nguyen
*Assistant Examiner* — John Bamert
(74) *Attorney, Agent, or Firm* — Stein IP LLC

(57) ABSTRACT

A system to provide a warning to a person in a vehicle when the vehicle is proximal or in a danger area to an emergency services vehicle or a hazard area, the system comprising an emitter on the emergency services vehicle or in or adjacent the hazard area, a radio associated with the vehicle, the radio having a receiver to receive the signal from the emitter, a speaker, a decoder to send a warning signal to the speaker when the receiver receives a signal from the emitter.

9 Claims, 2 Drawing Sheets

EMERGENCY SIGNAL INTERCEPTING UNIT

The present application claims the benefit of prior Australian Application No. 200603590, filed Aug. 18, 2006.

FIELD OF THE INVENTION

This invention is directed to an apparatus that can be fitted to a passenger vehicle or some other type of road vehicle (or possibly even a water vessel) and which will give an alarm signal or something similar to the person in the vehicle when the vehicle is relatively close to an emergency services vehicle (for instance an ambulance or fire truck) or to a hazard site or area (for instance a road closure etc). The invention is particularly directed to a modification or addition to a vehicle radio such that much of the componentry of the vehicle radio can be used.

BACKGROUND ART

A major problem in cities is the inability of an emergency vehicle such as an ambulance, police vehicle, fire truck etc to quickly get to an accident scene or to a hospital etc safely. One problem comes about because other vehicles on the road do not notice the emergency vehicle and therefore do not get out of the way. For this reason, emergency vehicles are provided with a loud siren. This should allow a driver in a vehicle to hear the emergency vehicle even if the emergency vehicle cannot be immediately seen. Often, the person in a vehicle does not hear the siren and therefore is not aware of the emergency vehicle proximity. This can be caused by good soundproofing in the vehicle, air-conditioning (which means that the vehicle windows are closed) or the radio being on in the vehicle.

Another problem which can occur anywhere on a roadway is a partially concealed risk area which is not seen by the driver of the vehicle until too late. These risk areas may include railway crossings, one-way bridges, road works, a bridge closed, an accident on the road and the like.

There may have been some attempts to notify the driver of a vehicle of the proximity of an ambulance or something else. However, these attempts may not have been particularly successful for various reasons including complexity and cost of the apparatus, difficulty in installation, effectiveness, potential distraction to motorists, perceived acceptance by consumers, interference with public and the like.

There would be an advantage if it were possible to provide some form of unit or apparatus that could provide an alarm or some other type of warning to a person in the vehicle if the vehicle is in close proximity to an ambulance, or a hazard situation and the like. There would be an advantage if this could be done in a relatively inexpensive manner and particularly by using some of the componentry of an existing vehicle radio, also enabling explicit information to be broadcast.

By doing so, this can obviate or reduce the need to have various components fitted to the vehicle such as a separate speaker, battery, or receiving circuitry and the like. These components might be unsightly if retrofitted to a vehicle and therefore consumer acceptance might be reduced.

A disadvantage with existing devices is that the warning sound may not be heard above the sound system. Therefore there would be an advantage if it were possible to mute or interrupt, the music etc on the radio/sound system when the signal is received and replace it with a warning sound.

Another potential disadvantage with possible existing devices is that if the device intercepts an emergency signal and activates a warning in the driver vehicle, the warning (e.g. alarm) might be activated for as long as the device picks up the emergency signal and this can be for a long period of time which can be quite annoying to the driver in the vehicle. However, it is not considered a good solution to have some form of timer to automatically switch off the alarm as the alarm may be switched off before the driver recognises the alarm and takes precautions. It should be appreciated that different drivers will have different reflex times to recognise the alarm and to take precautions.

Another advantage with integrating with existing componentry is that it is relatively simple & therefore inexpensive to automatically mute the existing vehicles sound system, therefore ensuring that the driver not only receives a clear uninterrupted warning, but is able to apply full concentration to the potential hazard rather than turning down volume of radios, activating acknowledge switches, looking at screens & etc.

There may be an advantage if it were possible to provide some form of unit or apparatus that could also have some form of feedback mechanism to make sure that the vehicle driver has acknowledged the alarm. To explain, there might be circumstances where even if the alarm activates, the driver of the vehicle does not recognise the alarm and therefore does not take extra precautions.

It is envisaged that this unit could become an integral part of a vehicle sound system.

While some form of warning of the type above would be particularly suitable for the driver of a road vehicle, it is envisaged that there may be circumstances where something similar would be suitable for a water vessel or some other form of transport means.

It is considered that the present invention would find particular suitability for all types of road vehicles that are fitted with a radio and these may include cars, trucks, utility vehicles, lorries, vans, semi trailers, some types of agricultural machinery such as tractors, haul out vehicles, buses, motorcycles (it being appreciated that many motorcycles are fitted with radios), taxis, and the like.

It is also considered that the present invention could comprise a radio which is portable and which is adapted to accommodate the apparatus of the present invention thereby enabling a vehicle which is not otherwise fitted with a radio to be used. This may include bicycles, some types of road using machinery that is usually not fitted with a radio, and the like.

It is also envisaged that the apparatus could become standard equipment for all types of vehicles.

The term "alarm" (if present in the invention) is meant to include a visual alarm such as a flashing light, an audible alarm and the like.

It will be clearly understood that, if a prior art publication is referred to herein; this reference does not constitute an admission that the publication forms part of the common general knowledge in the art in Australia or in any other country.

OBJECT OF THE INVENTION

It is an object of the invention to provide an apparatus or a system to allow the driver of a vehicle to be warned of the proximity of an emergency vehicle or risk area or something similar.

In one form the invention resides in a system or method to provide a warning to a person in a vehicle when the vehicle is proximal or in a danger area to an emergency services vehicle or a hazard area, the system or method comprising an emitter on the emergency services vehicle or in or adjacent the hazard area, a radio associated with the vehicle, the radio having a receiver to receive the signal from the emitter, a speaker, and a decoding means to send a warning signal to the speaker when the receiver receives a signal from the emitter.

The system or method may mute (e.g. interrupt the sound system) to allow the warning system to be clearly heard.

There may be circumstances where it may be desirable to have a switch which needs to be operated by the person in the vehicle to acknowledge the warning signal and to switch off the warning. However, the system may also operate without a switch.

An advantage of having the switch (if provided) is that it allows the driver to switch off the warning (for instance an alarm) when the driver has recognised the warning. Thus, if the driver fails to recognise the warning, the warning will continue until such time as the switch has been activated.

Another advantage of having a switch is that once a warning has been recognised and the switch has been operated, the system can be reset which means that if another emergency services vehicle is in the vicinity, the warning will sound to alert the driver that there is now a second emergency services vehicle in the vicinity, and the driver can take extra precautions.

The vehicle may comprise any type of road vehicle, off-road vehicle, and the like which could benefit from the system according to the present invention. Various types of vehicles have been described previously.

The system is designed to provide a warning when the vehicle is proximal or in a danger area to an emergency vehicle or a hazard area. The term "proximal" is meant to include a distance between the vehicle and the emergency vehicle which is sufficient to allow the driver of the vehicle to take precautions. Thus, it is envisaged that proximal will include a distance of between 10-300 m although there may be circumstances where a lesser or greater distance may be required. For instance, if the system is fitted to a heavy duty semi trailer, a larger distance may be required to enable the semi trailer to take precautionary action.

The term "danger area" in respect of any emergency services vehicle is meant to include the area where a dangerous circumstance may occur either with the vehicle or the emergency services vehicle if the emergency services vehicle is not recognised by the driver of the car etc.

The term "emergency services vehicle" is meant to include an ambulance, a fire truck, a police vehicle, and the like, although it is not considered that the term should be restricted only to these exemplifications.

The term "hazard area" is meant to include any place, area or zone which would be a risk should the driver of the vehicle enter into the area without being alerted of the potential hazard. Thus, the term can include a railway crossing, a narrow bridge, a particularly dangerous intersection, a sudden decrease in speed limits, a sudden bend in the roadway, road works, possibly an accident that has occurred already, a broken down vehicle that may comprise a collision hazard, and the like.

The emitter may comprise a relatively simple unit which may contain its own power source or may be powered by the emergency services vehicle or by some other power source. The emitter emits a signal which can be picked up by the receiver. It is preferred that the signal is a relatively low powered signal having a range of between 100-1000 m and typically about 300 m. If desired, the signal can be directed to the front of the emergency services vehicle such that the signal will be picked up only if the emergency services vehicle is behind the passenger vehicle etc. (it being appreciated that this is probably the most likely position where the emergency services vehicle will not be noticed by a driver).

The emitter may be a radio signal and may be a UHF or VHF signal and the frequency may be dependent on what restricted frequencies are used by the emergency services the vehicles or by other regulatory authorities.

Similarly, if the emitter is next to a road hazard or some other form of hazard area, the signal may be directed such that it will be picked up only by a road vehicle travelling towards the road hazard in a direction where the road hazard will present an actual hazard. If the road hazard will present a hazard in all directions, the signal may be a nondirectional signal. However, if the road hazard presents a hazard only in one direction, the signal may be directed to that one direction. This can reduce unnecessary triggering of the receiver in the vehicle, when there is no hazardous situation.

The emitter can emit any type of signal which can act as a warning to a person in the vehicle containing the receiver. The signal may be analog or digital. If desired, the signal may comprise an audio signal such as a siren sound. Alternatively, the signal may comprise a spoken audio signal giving the warning.

There may be an advantage in having a different signal for each different type of emergency vehicle. Thus, the emitter on an ambulance make transmit a signal such as "Warning Ambulance is in the Vicinity", while the emitter on a fire truck may transmit a signal such as "Warning Fire Truck is in the Vicinity". Alternatively, the signal may comprise the ordinary warning siren of the particular type of emergency vehicle.

In a more sophisticated arrangement, the emitter may transmit a message in real time. For instance, the emitter may be mounted to a police vehicle and may transmit a spoken message from the police officer in the police vehicle to the "offending" vehicle.

If the emitter is mounted in a hazard area (such as a bridge that has been closed for repairs), the emitter may emit a spoken warning signal such as "Warning Bridge Closed Ahead".

If the emitter is mounted next to a railway level crossing, it may emit a signal only when a train is in the vicinity and the signal may be "Warning Train is Crossing the Road" or may comprise the normal horn sound of the train.

The radio which is associated with the vehicle may comprise any type of factory fitted radio or aftermarket radio. These radios typically include a CD player or a tape player and the like, and the radios are mostly of the type that can receive an AM or FM signal. The radio is mostly powered by the vehicle battery system.

The radio will typically have some form of receiver which may include the radio antenna and circuitry within the radio to receive an AM or FM signal.

The radio will also be coupled to or contain one or more speakers, and many modern cars are provided with a number of speakers.

Some form of decoder means is provided. The decoder typically functions to send a received signal to the vehicle speaker. Thus, irrespective of whether the radio is turned on or turned off or on what station the radio is on, or whether the radio is on a FM station or an AM station CD, cassette, MP3 etc, a warning signal will be sent to the vehicle speaker by the decoder if a received signal is sensed. If necessary, some form of amplification unit can be provided as well.

Some form of automatic changeover switch is preferably be provided to switch the signal from the car radio to the decoder means when an emergency signal is sensed.

Some form of switch or button or something similar can be provided to acknowledge the warning signal (e.g. a visual and audio signal) and when activated, to "reset" or return the speakers to normal operation (that is connected to the radio).

BRIEF DESCRIPTION OF THE DRAWINGS

An embodiment of the invention will be described with reference to the following drawings in which.

BEST MODE

Figure 1:
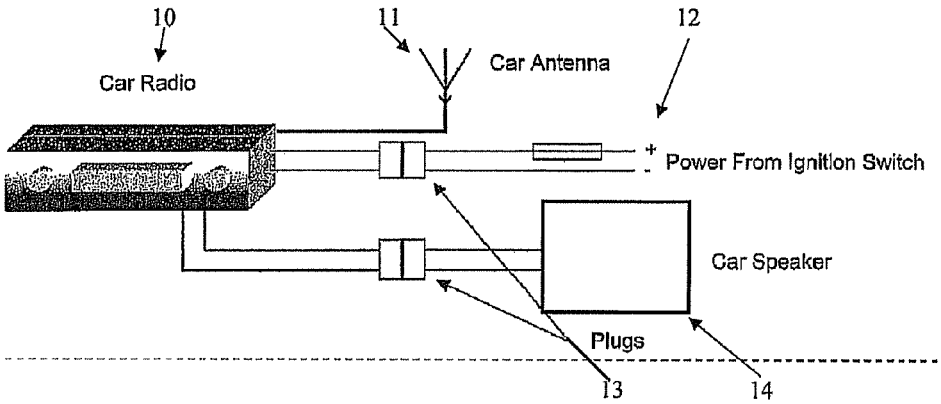
FIG 1 (Prior Art)
FIG. 1. Illustrates a conventional car radio set up.

Referring to the illustrations, and initially to FIG. 1, there is illustrated an existing car radio set up and the various components are clearly identified in FIG. 1. These comprise a car radio 10, a car antenna 11, power from the ignition switch 12, various plugs 13, and a car speaker 14. It should be appreciated that FIG. 1 is only a rough schematic and the number of car speakers etc can vary.

Figure 2:
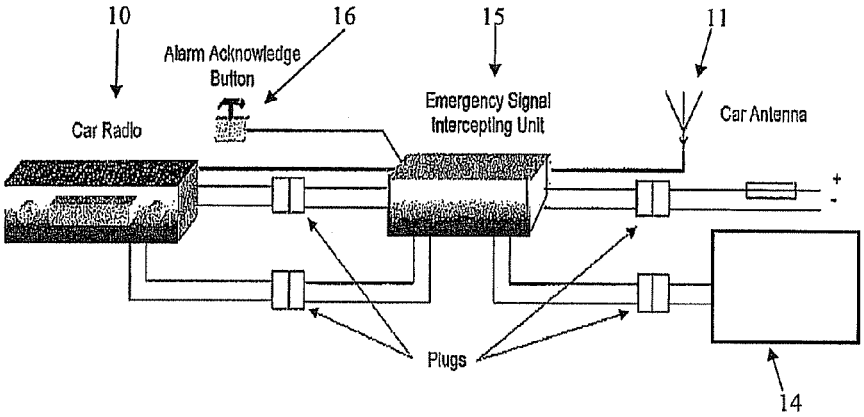
FIG. 2. Illustrates an apparatus according to an embodiment of the invention fitted to a vehicle.

FIG. 2 illustrates an apparatus according to an embodiment of the invention (called an emergency signal intercepting unit 15) modifying the existing car radio set up of FIG. 1. Unit 15 plugs in between existing car radio, power supply, speakers and antenna. (In future systems this may become integral with sound systems), It is clear from FIG. 2 that the emergency signal intercepting unit 15 of the invention is located in the system between the car antenna, the speakers and the power source of the car and the car radio. The location and connections of the emergency signal intercepting unit 15 as illustrated in FIG. 2, make it clear that in normal operation of the car radio, the power is supplied to the radio through the unit and the radio plays through the unit and thence to the speaker 14. It is also clear that the emergency signal intercepting unit 15 can receive a signal via the antenna and power the speakers to play a warning, without relay though the radio.

Figure 3:
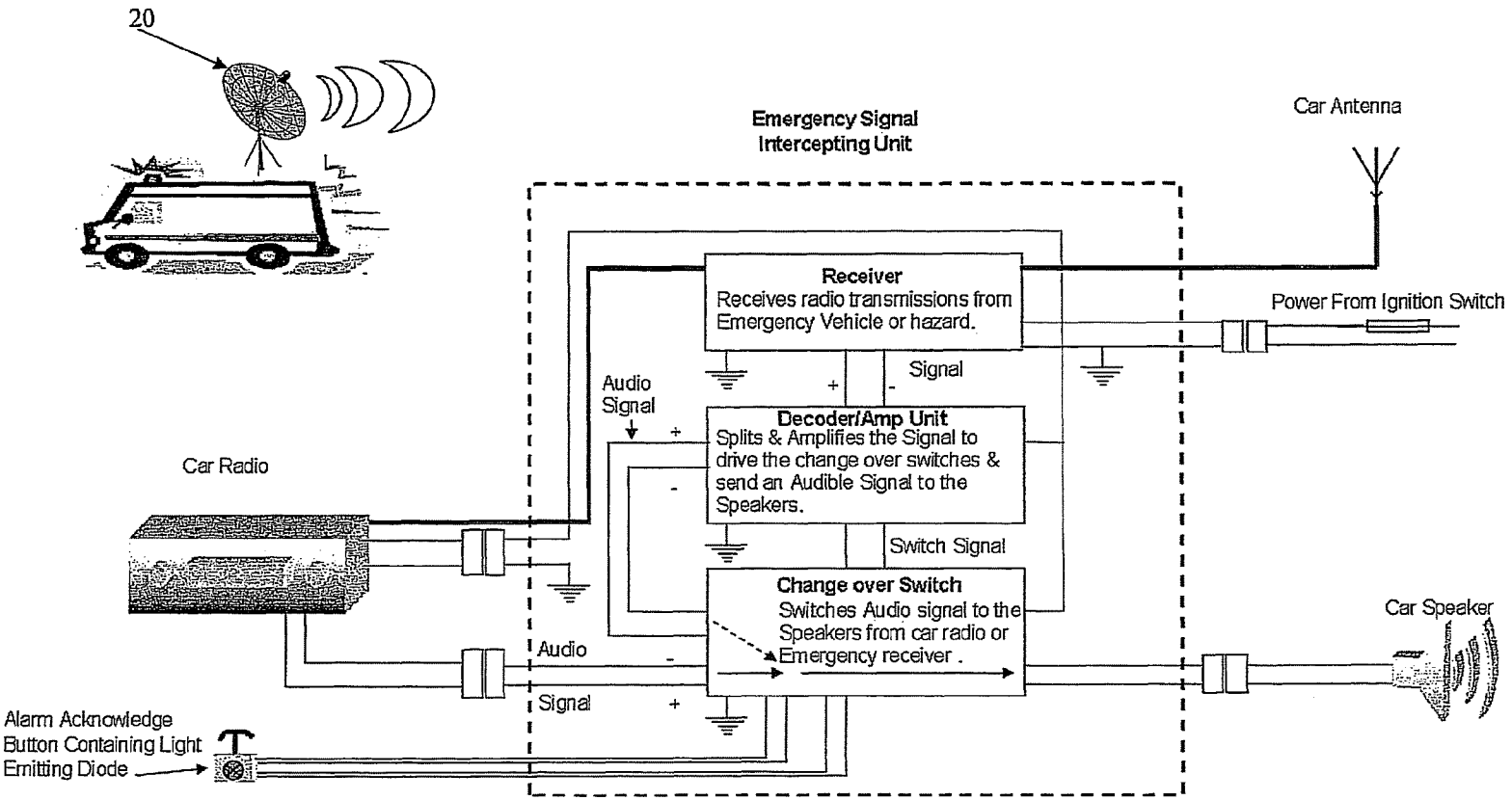
FIG. 3. Illustrates in greater detail the componentry of the apparatus.

FIG. 3 illustrates in greater detail the componentry of the unit 15.

The emitter on the emergency vehicle can also be manually switched on or switched off such that it can be used only when there is a need to warn vehicles in the vicinity. This could be a manual switch, integrated into emergency lights and/or sirens, operated via RF transmitter or the like.

FIG. 3 illustrates in greater detail the componentry of the unit 15. One optional component is a manual switch 16. When a warning signal is received by unit 15, the warning signal will be sent to speakers 14. Speakers, will sound the warning system until the driver of the vehicle activates switch 16, which will switch off the warning signal and return the speakers to normal operation even if the emitter from the emergency services vehicle is still within proximity to the driver in the vehicle.

As soon as switch 16 has been activated, the system will sound another warning if a new emergency transmission is made and switch 16 will then need to be activated once again to return the speakers to normal operation.

The emitter on the emergency vehicle can also be manually switched on or switched off such that it can be used only when there is a need to warn vehicles in the vicinity.

Thus, the apparatus is a device that receives a low powered short range radio signal transmitted from an emergency service vehicle or roadside hazards etc using the existing radio aerial and car power supply. When the signal is received, an interrupter interrupts the music etc on the radio and replaces it with a warning sound. The radio can be put back into the normal service by acknowledging the emergency transmission by activating switch 16.

The switch is optional.

Thus, the apparatus is a device that receives a low powered short range radio signal transmitted from an emergency service vehicle or roadside hazards etc using the existing radio aerial and car power supply. When the signal is received, it interrupts the music etc on the radio and replaces it with a warning sound. The radio would be put back into the normal service once the signal is no longer received. The system will work even if the radio is turned off.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

The invention claimed is:

1. A system to provide a warning to a person in a vehicle when the vehicle is proximal or in a danger area to an emergency services vehicle or a hazard area, the system comprising a. an emitter on the emergency services vehicle or in or adjacent the hazard area;

b. a radio associated with the vehicle and a receiver sub-unit to receive a signal from the emitter, and at least one speaker; of the vehicle; and c. a unit including i. the receiver sub-unit to receive a radio transmission from the emitter on the emergency services vehicle or in or adjacent to the hazard area, ii. a decoder sub-unit to send a warning signal to a changeover switch sub-unit; and iii. the changeover switch sub-unit switching between an audio signal from the radio and the warning signal from the decoder sub-unit and sends the warning signal to the at least one speaker when the receiver sub-unit receives the signal from the emitter to interrupt a radio output when the warning signal is sent;

iiii. the unit connected to the at least one speaker and a vehicle power source such that the warning signal is produced by at least one speaker from the decoder sub-unit through the changeover switch sub-unit when received without the warning signal relaying through the radio, the unit connected between the radio of the vehicle and the power source such that if the unit fails, the at least one speaker remains unpowered and will not function and the changeover switch sub-unit being normally closed to the decoder sub-unit; and d. a cancelling switch to cancel the warning signal and return the speakers to normal operation even if the emitter is still within proximity to the vehicle to prevent the warning signal from being reactivated by the emergency services vehicle or whilst within or adjacent to the hazard area but allowing warning signals to be produced based on a radio transmission from the emitter on a second or further emergency services vehicle or in or adjacent to a second or further hazard area.

2. The system as claimed in claim 1, wherein the unit is coupled to an antenna of a vehicle and if a signal is received from the emitter, will send the warning signal to the vehicle speakers.

3. The system as claimed in claim 2, wherein the unit is powered from the vehicle.

4. The system as claimed in claim 2, wherein the warning signal comprises an audio signal.

5. The system as claimed in claim 1, wherein the unit is associated with an existing sound system associated with the radio and the unit mutes the existing sound system to interrupt any sound output therefrom whilst the warning is produced.

6. The system as claimed in claim 5 wherein the unit interrupts the existing sound system regardless of the operational mode of the sound system.

7. The system as claimed in claim 1, wherein the unit is wired into a vehicle sound system to become an integral part of the vehicle's sound system.

8. The system as claimed in claim 1, wherein the unit is portable.

9. The system as claimed in claim 1 wherein the unit can be reset once activated to interrupt the radio output.

* * * * *